US009655461B2

(12) United States Patent
Littlejohn

(10) Patent No.: US 9,655,461 B2
(45) Date of Patent: May 23, 2017

(54) PRESSWARE PAPERBOARD PLATE WITH WIDE BRIM AND GREATER STRENGTH

(71) Applicant: Dixie Consumer Products LLC, Atlanta, GA (US)

(72) Inventor: Mark B. Littlejohn, Appleton, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 0 days.

(21) Appl. No.: 15/255,790

(22) Filed: Sep. 2, 2016

(65) Prior Publication Data

US 2017/0065110 A1 Mar. 9, 2017

Related U.S. Application Data

(60) Provisional application No. 62/215,602, filed on Sep. 8, 2015.

(51) Int. Cl.
*A47G 19/03* (2006.01)
*B65D 1/34* (2006.01)

(52) U.S. Cl.
CPC ..... *A47G 19/03* (2013.01)

(58) Field of Classification Search
CPC ..... A47G 19/03; B65D 1/34
USPC ..... 229/406, 407
See application file for complete search history.

(56) References Cited

U.S. PATENT DOCUMENTS

| | | | | |
|---|---|---|---|---|
| 4,606,496 | A * | 8/1986 | Marx | B65D 1/34 220/574 |
| 4,609,140 | A | 9/1986 | Van Handel et al. | |
| 4,721,500 | A | 1/1988 | Van Handel et al. | |
| 4,832,676 | A | 5/1989 | Johns et al. | |
| 5,088,640 | A | 2/1992 | Littlejohn | |
| 5,249,946 | A | 10/1993 | Marx | |
| 5,326,020 | A | 7/1994 | Cheshire et al. | |
| 5,938,112 | A | 8/1999 | Sandstrom | |
| 6,474,497 | B1 | 11/2002 | Littlejohn et al. | |
| 6,585,506 | B1 | 7/2003 | Johns et al. | |
| 6,589,043 | B1 | 7/2003 | Johns et al. | |
| 6,592,357 | B1 | 7/2003 | Johns et al. | |
| 6,715,630 | B2 | 4/2004 | Littlejohn et al. | |
| 6,733,852 | B2 | 5/2004 | Littlejohn et al. | |
| 6,893,693 | B2 | 5/2005 | Swoboda et al. | |
| 7,048,176 | B2 | 5/2006 | Littlejohn et al. | |
| 7,337,943 | B2 | 3/2008 | Johns et al. | |
| 7,980,450 | B2 * | 7/2011 | Swoboda | A47G 19/03 229/406 |

(Continued)

*Primary Examiner* — Gary Elkins

(57) ABSTRACT

A paperboard plate can include a bottom panel, a frustoconical sidewall extending upward and outward from the bottom panel, and four arcuate portions which have radius of curvatures R1, R2, R3, and R4. The plate can also include an inner brim section adjacent the frustoconical sidewall and having a width (W), an outer frustoconical brim section extending downward and out from the inner brim section, an outer perimeter section extending outward from the outer frustoconical brim section, the plate having an overall diameter (D). The radius of curvature (R3) can be less than 0.20 inches, a ratio of W/D can be 0.041 to 0.050, a ratio of R3/D can be 0.010 to 0.017, and the outer frustoconical brim section can extend downward and outward at an angle (A3) of 65° to 75° with respect to a vertical that is substantially perpendicular to the bottom panel.

10 Claims, 3 Drawing Sheets

(56) References Cited

U.S. PATENT DOCUMENTS

| | | | | |
|---|---|---|---|---|
| 8,177,119 | B2 | 5/2012 | Littlejohn | |
| 8,430,660 | B2 | 4/2013 | John et al. | |
| 8,584,929 | B2 | 11/2013 | Littlejohn et al. | |
| 8,651,366 | B2 | 2/2014 | Littlejohn et al. | |
| 8,794,440 | B2 * | 8/2014 | BeVier | B65D 1/34 206/507 |
| 2007/0042072 | A1 | 2/2007 | Johns et al. | |
| 2009/0173775 | A1 * | 7/2009 | Swoboda | A47G 19/03 229/407 |
| 2013/0098800 | A1 * | 4/2013 | Rehmanji | B65D 81/261 206/557 |

* cited by examiner

PRESSWARE PAPERBOARD PLATE WITH WIDE BRIM AND GREATER STRENGTH

BACKGROUND

Field

Embodiments described generally relate to disposable plates. More particularly, such embodiments relate to disposable pressed paperboard plates.

Description of the Related Art

Disposable containers such as plates, bowls, platters and the like are usually made of plastic, or are pulp molded, or are pressware made from flat paperboard blanks. Containers are typically round or oval in shape, but also can be hexagonal, octagonal, or multi-sided.

Pulp molded containers exhibit generally excellent dry strength as compared with many pressware containers; however, pulp molded containers are generally inferior to pressed paper products in terms of coating and decorative options because suitable printing and overcoating processes for pulp molded containers are relatively difficult and expensive as compared with available options for pressware. This is so because paperboard can be coated and printed prior to forming into shape. Pulp molded products are accordingly usually uncoated and not as resistant to grease and moisture as are pressware products with suitable latex coatings. Most plastic or foam plates have a limited heat/reheat range, and can soften or melt with hot foods or during microwave use. Thus, pressware containers are preferred in many cases.

Pressware containers have been produced with various flange profiles as is seen in the patent literature. U.S. Pat. No. 8,651,366 discloses more rigid, fluted paperboard containers made with an arcuate outer region. U.S. Pat. No. 8,584,929 discloses pressed paperboard servingware with an outer flange portion that provides improved rigidity and rim stiffness. U.S. Pat. No. 8,177,119 discloses pressed paperboard servingware with an arched bottom panel and sharp brim transition. U.S. Pat. No. 5,326,020 discloses a container with a plurality of frusto-conical regions extending outwardly from the bottom of the container, while U.S. Pat. No. 5,088,640 discloses a rigid four radii rim paper plate. U.S. Pat. No. 6,715,630 discloses a disposable container having a linear sidewall profile and an arcuate outer flange as well as U.S. Pat. No. 7,048,176 that discloses a deep dish disposable container made from a paperboard blank. Processing techniques and equipment are further detailed in U.S. Patent Publication No. 2007/0042072. The '072 publication details apparatus and equipment suitable for making pressware at high throughput rates.

While pressed paper plates can be produced with exceptional rigidity as a result of their design (profile) and process (pleat pressing), they are typically not as strong as pulp molded plates that do not have folds/pleats and can lose substantial strength during repeated use as a result of opening/hinging of the folds/pleats and buckling of the paperboard at their very outermost edge. The shape/profile that the pressed paper plates are formed with significantly affects the product strength, durability and resulting consumer perception and purchase intent.

Notwithstanding the many improvements already made in connection with pressware products, there is an ever present demand for pressware products with increased rigidity and increased load-bearing capability.

SUMMARY

In one or more examples, a disposable paperboard plate can include a bottom panel, a frustoconical sidewall, a first arcuate portion, an inner brim section, and a second arcuate portion. The frustoconical sidewall can extend upward and outward from the bottom panel. The first arcuate portion can be located between the bottom panel and a first end of the frustoconical sidewall, and can have a radius of curvature (R1). The inner brim section can be adjacent the frustoconical sidewall and can have a width (W). The second arcuate portion can be located between a second end of the frustoconical sidewall and a first end of the inner brim section, and can have a radius of curvature (R2). The plate can also include an outer frustoconical brim section, an outer perimeter section, a third arcuate portion, and a fourth arcuate portion. The outer frustoconical brim section can extend downward and out from the inner brim section. The outer perimeter section can extend outward from the outer frustoconical brim section, and can have an overall diameter (D). The third arcuate portion can be located between the inner brim section and the outer frustoconical brim section, and can have a radius of curvature (R3) that is less than 0.20 inches. The fourth arcuate portion can be located between the outer frustoconical brim section and the outer perimeter section, and can have a radius of curvature (R4). A ratio of W/D can be 0.041 to 0.050, a ratio of R3/D can be 0.010 to 0.017, and the outer frustoconical brim section can extend downward and outward at an angle (A3) of 65° to 75° with respect to a vertical that is substantially perpendicular to the bottom panel. In some examples, the bottom panel can have an arched central crown with a convex upper surface.

BRIEF DESCRIPTION OF THE DRAWINGS

So that the manner in which the above recited features is understood in detail, a more particular description, briefly summarized above, may be had by reference to embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
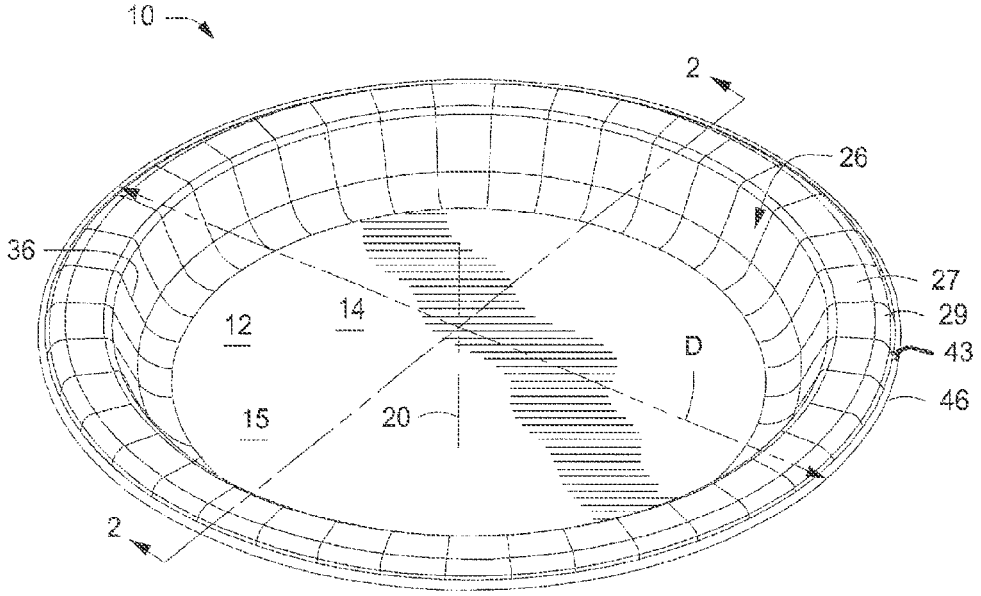
FIG. 1 depicts a perspective view of a plate, according to one or more embodiments described.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this disclosure is combined with publicly available information and technology.

Disposable containers having a unique combination of improved strength and rim stiffness are provided. The disposable containers can be any container in the form of a plate, bowl, tray, platter, or non-round shape. The disposable containers also can be round, square, rectangular or have other multi-sided configurations. The disposable containers also can be compartmented or not.

The disposable containers discussed and described herein generally have an overall diameter or dimension from end to end. For circular bowls, plates, platters and the like, the overall diameter is simply the outer diameter of the product. For other shapes, an average diameter is used. For example, the arithmetic average of the major and minor axes is used for oval or elliptical shapes, whereas the average length of the sides of a rectangular shape is used as the overall diameter and so forth. Sheet stock refers to both a web or a roll of material and to material that is cut into sheet form for processing. Unless otherwise indicated, "mil", "mils" and like terminology refer to thousandths of an inch and dimensions appear in inches. Likewise, caliper is the thickness of material and is expressed in mils unless otherwise specified. Basis weight is expressed in lbs per 3,000 square foot ream, while "ream" refers to 3,000 $ft^2$.

Dimensions, radii of curvature, angles and so forth are measured by using conventional techniques such as laser techniques or using mechanical gauges including gauges of curvature as well as by any other suitable technique. While a particular arcuate section of a container may have a shape which can be not perfectly arcuate in radial profile, perhaps having some other generally bowed shape either by design or due to off center forming, or due to relaxation or spring-back of the formed paperboard, an average radius approximating a circular shape can be used for purposes of determining radii such as R1, R2, or R0, for example. A radius of curvature may be used to characterize any generally bowed shape, whether the shape can be arcuate or contains arcuate and linear segments or comprises a shape made up of joined linear segments in an overall curved configuration. In cases where directional variation around the container exists, average values are measured in a machine direction (MD1) of the paperboard, at 90° thereto, the cross machine direction (CD1) of the paperboard as well as at 180° to MD1 and 180° to CD1. The four values are then averaged to determine the dimension or quantity.

While the distinction between a pressware "bowl" and "plate" can be sometimes less than clear, especially in the case of "deep dish" containers, a bowl generally has a height to diameter ratio of 0.15 or greater, while a plate generally has a height to diameter ratio of less than 0.1 in most cases. A "platter" can be a large shallow plate. A plate, platter, or bowl can be oval or any shape other than round (e.g., polygonal).

The phrase "a substantially continuous, convex arched profile" refers to an arch structure which slopes downwardly and outwardly from center (or approximately from center) in a generally continuous manner. For example, less than 30% of the arch profile length can be horizontally extending, the arch profile otherwise sloping downwardly and outwardly generally from around the center of the container toward the first annular transition. In some examples, about 20% or less or about 10% or less of the arch profile length can include horizontally extending portions. In some configurations, the convex upper surface of the arched central crown can have the shape generally of a spherical or spheroidal cap.

"Evert", "annular evert", "evert portion" and like terminology refer to an outwardly extending part of the container that can be typically located at the outer flange of the container adjoining a transition from a downwardly sloping brim portion of the plate or other container.

"Rigidity" refers to FPI Rigidity in grams at 0.5" deflection as further discussed below.

"Rim Stiffness" refers to the Rim Stiffness in grams at 0.1" deflection as further discussed below.

"Center Arch Stiffness" and like terminology refers to deflection at center of an inverted container which simulates the flexing of a plate as sensed, for example, by the fingertips of a user as the plate can be loaded.

Figure 2:
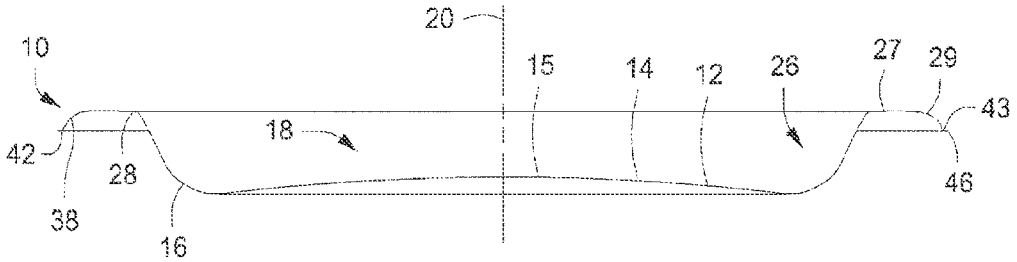
FIG. 2 depicts a cross-sectional view of the plate taken along line 2-2 in FIG. 1.

FIG. 1 depicts a perspective view of a disposable paperboard plate 10, and FIG. 2 depicts a cross-sectional view of the plate taken along line 2-2. The plate 10 can have a bottom panel 12 that is substantially horizontal or substantially flat. The bottom panel 12 also can have an arched central crown 14 with an upper surface 15 that can be convex, as depicted in FIG. 2. The plate 10 can further include a frustoconical sidewall 26 extending upward and outward from the bottom panel 12. The plate 10 can further include an inner brim section 27 adjacent the frustoconical sidewall 26. The inner brim section 27 can be horizontal or substantially horizontal (e.g., about −2° to about)+2°. The inner brim section 27 also can be angled upward or downward (by plus or minus 2° to 5°) with respect to the horizontal.

An outer frustoconical brim section 29 can extend downward and out from the inner brim section 27. An outer perimeter section 43 (e.g., evert) can extend outward from the outer frustoconical brim section 29. The outer perimeter section 43 is generally straight and can be parallel or substantially parallel (e.g., about −2° to about)+2° to the bottom panel 12. The outer perimeter section 43 also can be generally straight and angled upward or downward (by plus or minus 2° to 5°) with respect to the horizontal.

The plate 10 also can include a gravy ring formed within the bottom panel 12 and peripherally disposed around the bottom panel 12 between the arched central crown 14 and the frustoconical sidewall 26. The gravy ring can allow any liquid on the upper surface 15 to accumulate therein.

The plate 10 also can include a second arcuate portion 28 that is located between a second end of the frustoconical sidewall 26 and a first end of the inner brim section 27. The second arcuate portion 28 can flare outwardly with respect to the first arcuate portion 16 and can have a radius of curvature (R2).

The plate 10 also can include a third arcuate portion 38 having a radius of curvature (R3) that can be located between the inner brim section 27 and the outer frustoconical brim section 29. A fourth arcuate portion 42 having a radius of curvature (R4) can be located between the outer frustoconical brim section 29 and the outer perimeter section 43.

Figures 3, 5, 6, 7:
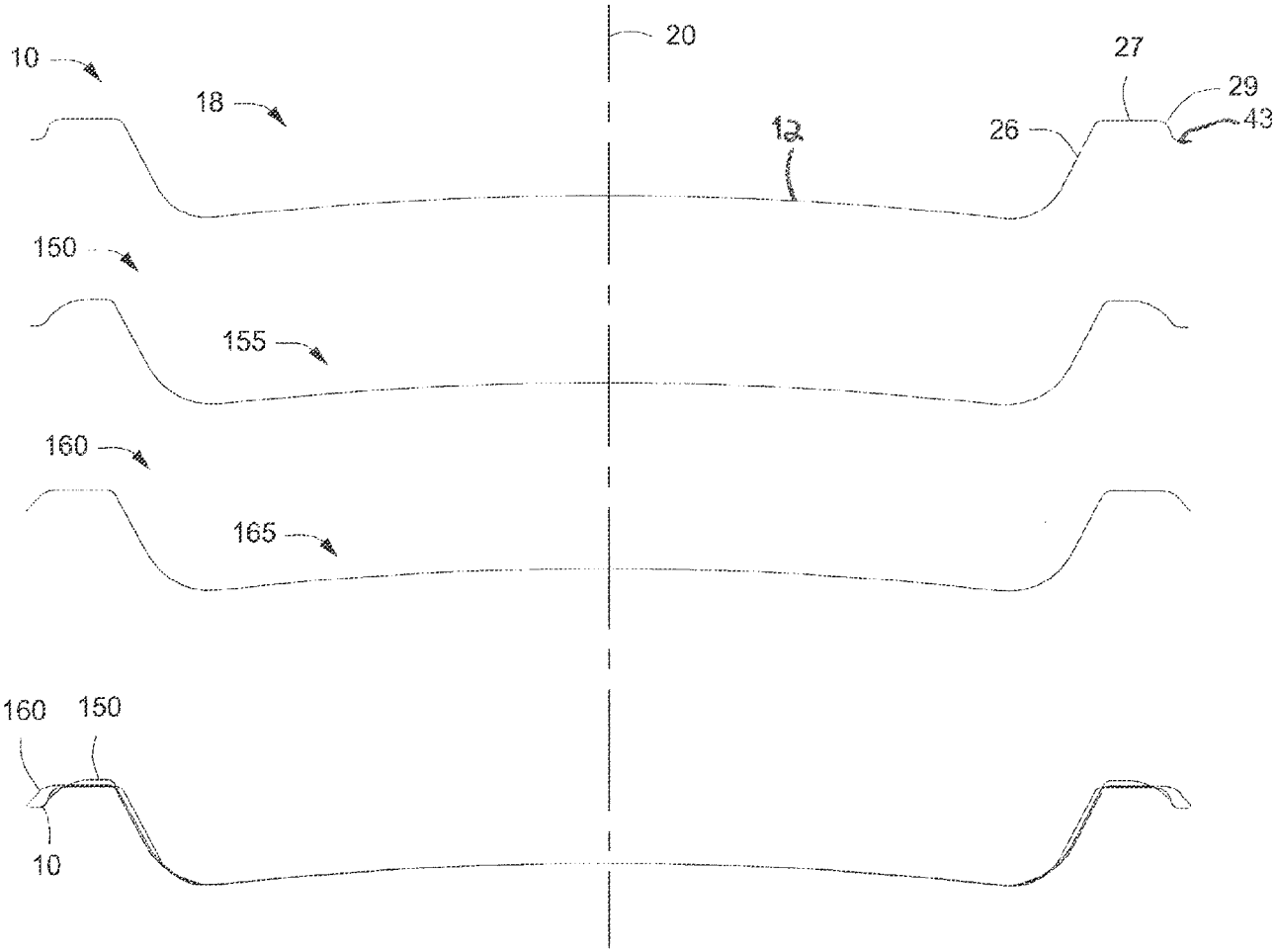
FIG. 5 (PRIOR ART)
FIG. 6 (PRIOR ART)
FIG. 3 depicts the profile of the plate shown in FIG. 1.
FIG. 5 depicts a representative profile of a prior art plate having a DU-shape.
FIG. 6 depicts another representative profile of a prior art plate having a D-shape.
FIG. 7 depicts an overlay of the plate profiles shown in FIGS. 3, 5, and 6.

FIG. 3 depicts the profile of the plate shown in FIG. 1. Referring to FIGS. 2 and 3, the upper surface 15 of the arched central crown 14 defines a substantially continuous, convex arched profile 18 extending from a center 20 of the plate 10 toward a first arcuate portion 16. The first arcuate portion 16 can have a radius of curvature (R1) that can be located between the bottom panel 12 and a first end of the frustoconical sidewall 26. The highest point of the arched central crown 14 can be located at the center 20. The highest point of the arched crown also can occur off center due to a forming a blank that was not perfectly aligned in a die set, due to relaxation or spring back, and/or by design.

Figure 4A:
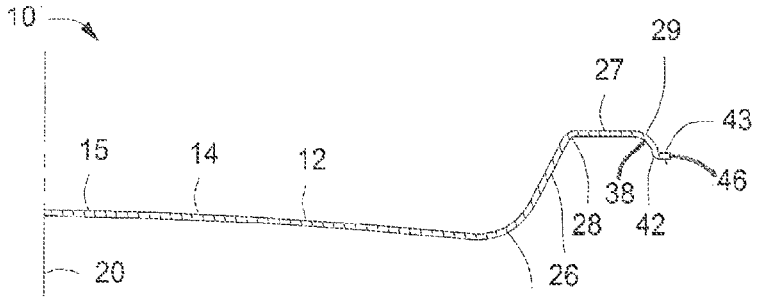
FIG. 4A depicts the profile from the center of the plate shown in FIG. 1.
Figure 4B:
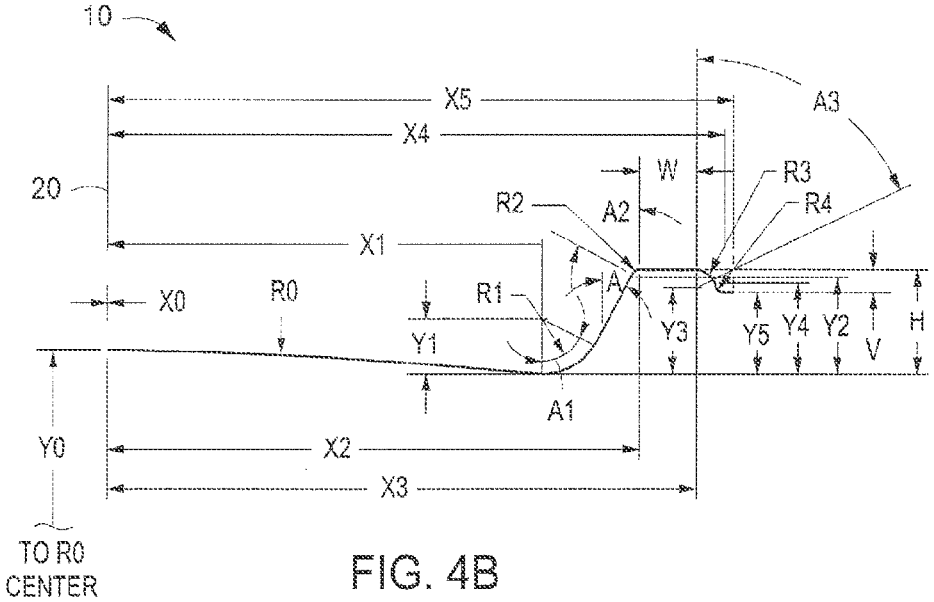
FIG. 4B is a schematic diagram illustrating the nomenclature for various dimensions of the plate shown in FIG. 1.

FIG. 4A depicts the profile from the center of the plate 10, and FIG. 4B can be a schematic diagram illustrating the nomenclature for the various dimensions of the plate 10. The plate 10 can have an overall diameter (D). The overall diameter of the plate 10 can range from a low of about 6 in., about 7 in., or about 8 in. to a high of about 9 in., about 10 in., or about 12 in. The overall diameter (D) also can be about 6 in. to about 12 in., about 6 in. to about 10 in., about 6 in. to about 8 in., about 8 in. to about 12 in., about 8 in. to about 10 in., about 10 in. to about 12 in., about 8.5 in. to about 10.5 in., or about 8.5 in. to about 11.5 in.

The inner brim section 27 can have a width (W). The width (W) of the inner brim section 27 can range from a low of about 0.30 in., about 0.40 in., or about 0.45 in. to a high of about 0.50 in., about 0.55 in., about 0.60 in., or greater. For example, the width (W) of the inner brim section 27 can range from about 0.30 in. to about 0.60 in., about 0.40 in. to about 0.50 in., about 0.40 in. to about 0.55 in., or about 0.45 in. to about 0.55 in.

A ratio of W/D (i.e., the width (W) of the inner brim section 27 divided by the overall diameter (D) of the plate 10) can range from a low of about 0.040, about 0.043, or about 0.045 to a high of about 0.046, about 0.048, or about 0.050. The ratio of W/D of the plate 10 also can be about 0.041 to about 0.050, about 0.041 to about 0.048, about 0.041 to about 0.045, about 0.043 to about 0.050, or about 0.043 to about 0.048.

The radius of curvature (R1) can be about 0.3 in., about 0.35 in., or about 0.4 in. to about 0.5 in., about 0.55 in., or about 0.6 in. For example, the radius of curvature (R1) can be about 0.3 in. to about 0.6 in., about 0.4 in. to about 0.6 in., about 0.35 in. to about 0.55 in., or about 0.35 in. to about 0.5 in. The radius of curvature (R1) can also be greater than 0.3 in., greater than 0.35 in., or greater than 0.4 in. to less than 0.5 in., less than 0.55 in., or less than 0.6 in. For example, the radius of curvature (R1) can be greater than 0.3 in. to less than 0.6 in., greater than 0.4 in. to less than 0.6 in., greater than 0.35 in. to less than 0.55 in., or greater than 0.35 in. to less than 0.5 in.

The radius of curvature (R2) can be about 0.025 in., about 0.035 in., or about 0.05 in. to about 0.06 in., about 0.08 in., or about 0.1 in. For example, the radius of curvature (R2) can be about 0.025 in. to about 0.1 in., about 0.035 in. to about 0.1 in., about 0.035 in. to about 0.08 in., or about 0.035 in. to about 0.06 in. The radius of curvature (R2) can also be greater than 0.025 in., greater than 0.035 in., or greater than 0.05 in. to less than 0.06 in., less than 0.08 in., or less than 0.1 in. For example, the radius of curvature (R2) can be greater than 0.025 in. to less than 0.1 in., greater than 0.035 in. to less than 0.1 in., greater than 0.035 in. to less than 0.08 in., or greater than 0.035 in. to less than 0.06 in.

The radius of curvature (R3) can be about 0.06 in., about 0.08 in., or about 0.1 in. to about 0.12 in., about 0.16 in., or about 0.2 in. For example, the radius of curvature (R3) can be about 0.06 in. to about 0.2 in., about 0.1 in. to about 0.2 in., about 0.08 in. to about 0.16 in., or about 0.08 in. to about 0.12 in. The radius of curvature (R3) can also be greater than 0.06 in., greater than 0.08 in., or greater than 0.1 in. to less than 0.12 in., less than 0.16 in., or less than 0.2 in. For example, the radius of curvature (R3) can be greater than 0.06 in. to less than 0.2 in., greater than 0.1 in. to less than 0.2 in., greater than 0.08 in. to less than 0.16 in., or greater than 0.08 in. to less than 0.12 in.

The radius of curvature (R4) can be about 0.032 in., about 0.045 in., or about 0.055 in. to about 0.075 in., about 0.1 in., or about 0.125 in. For example, the radius of curvature (R4) can be about 0.032 in. to about 0.125 in., about 0.045 in. to about 0.125 in., about 0.045 in. to about 0.1 in., or about 0.045 in. to about 0.075 in. The radius of curvature (R4) can also be greater than 0.032 in., greater than 0.045 in., or greater than 0.055 in. to less than 0.075 in., less than 0.1 in., or less than 0.125 in. For example, the radius of curvature (R4) can be greater than 0.032 in. to less than 0.125 in., greater than 0.045 in. to less than 0.125 in., greater than 0.045 in. to less than 0.1 in., or greater than 0.045 in. to less than 0.075 in.

A ratio of R2/D can be 0.0125 or less. The ratio of R2/D also can be from about 0.0025 to about 0.0125 such as from about 0.005 or 0.006 to about 0.010. R2 also can be essentially 0, that can be, in essence a sharp direction change in the profile.

A ratio of R3/D (i.e., the radius of curvature (R3) divided by the overall diameter (D) of the plate 10) can range from a low of about 0.010, about 0.011, or about 0.012 to a high of about 0.013, about 0.015, or about 0.017. The ratio of R3/D also can range from about 0.010 to about 0.017, about 0.012 to about 0.017, or about 0.010 to about 0.015.

The outer frustoconical brim section 29 can extend downward and outward at an angle (A3) with respect to a vertical that is substantially perpendicular to the bottom panel 12, as depicted in FIG. 4B. The angle (A3) can range from a low of about 65°, about 67°, or about 69° to a high of about 71°, about 73°, or about 75°. The angle (A3) also can range from about 65° to about 75°, about 65° to about 70°, or about 70° to about 75°.

The frustoconical sidewall 26 can have an angle of inclination (A) with respect to a vertical that is substantially perpendicular to the bottom panel 12, as depicted in FIG. 4B. The angle of inclination (A) of the frustoconical sidewall 26 can range from a low of about 10°, about 20°, or about 25° to a high of about 30°, about 40°, or about 50°. The frustoconical sidewall 26 also can have an angle of inclination with respect to the bottom panel 12 of about 10° to about 50°, about 10° to about 40°, about 20° to about 30°, or about 20° to about 40°.

A ratio of the length of the frustoconical sidewall 26 to the overall diameter of the plate 10 can be greater than 0.02, greater than 0.03, greater than 0.04, greater than 0.05 or greater than 0.06. A ratio of the length of the frustoconical sidewall 26 to the overall diameter of the plate 10 also can be less than 0.10, less than 0.09, less than 0.08, or less than 0.07. A ratio of the length of the frustoconical sidewall 26 to the overall diameter of the plate 10 also can range from a low of 0.020, 0.025, or 0.035 to a high of 0.075, 0.085, or 0.010.

The plate 10 can have a plurality of pleats 36 that can extend from the first arcuate portion 16 to the evert 46. The pleats 36 can correspond to the scores of a scored paperboard blank and include a plurality of paperboard lamellae which are reformed into a generally inseparable structure which provides strength and rigidity to the container, as discussed in more detail hereinafter.

Still referring to FIG. 4B, Y indicates generally a height from the lowermost portion of the bottom of the container (with the exception of Y0 which can be the height of the crown from the origin of R0). For example, Y1 can be the height above the bottom of the container of the origin of radius of curvature R1 of first transition portion 16; Y2 can be the height above the bottom of the container of the origin of radius of curvature R2; Y3 can be the height above the bottom of the container of the origin of radius of curvature R3; Y4 can be the height above the bottom of the container of the origin of radius R4; and Y5 can be the height above the bottom of the container of evert 43. Similarly, X1 indicates the distance from center (X0) of the origin of radius of curvature R1. Likewise, X2 and X3 indicate respectively, the distance from the center of the plate (X0) of the origins of radii of curvature R2 and R3. Likewise, X4 indicates the distance from center of the origin radius of curvature, R4. X5 indicates the radius of the plate (i.e., half of diameter (D)).

Figure 8:
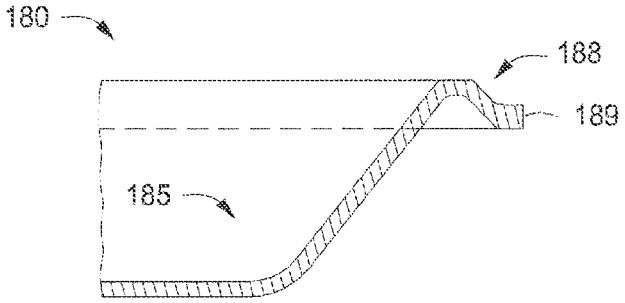
FIG. 8 (PRIOR ART)
FIG. 8 depicts a representative profile of a prior art plate that was pulp molded to have an outer evert and no radii of curvature within the plate brim.

FIGS. 5 and 6 depict representative profiles 155, 165 of prior art plates 150, 160 described in U.S. Pat. No. 8,177,119. FIG. 7 depicts an overlay of the profiles of the plates depicted in FIGS. 3, 5 and 6 to show relative differences between the profiles 18, 155, 165. As depicted, the plate 10 has a wider width (W), smaller R3/D and larger wrap shown by A3. FIG. 8 depicts a representative profile 185 of a prior art plate 180 described in U.S. Pat. No. 1,866,035. The plate 180 has an outer evert 189, but lacks a radii of curvature within the brim 188. The resulting rim and plate rigidities of these plates are compared below in the examples provided. It has been surprisingly discovered that the plate 10 as described herein possesses a significant 10% to 20% increase in plate rigidity (FPI) using standard paper thickness and weight, and do not substantially change the product bottom area, height, diameter, stack height, or packaging cube.

Methods for fabrication can employ segmented dies and paperboard plates can be manufactured with the segments dies from coated paperboard. Clay coated paperboard can be typically printed, coated with a functional grease/water resistant barrier and moistened prior to blanking and forming. The printed, coated and moistened paperboard roll can be then transferred to a web fed press where the blanks are cut in a straight across, staggered, or nested pattern (to minimize scrap). The blanks are transferred to the multi-up forming tool via individual transfer chutes. The blanks will commonly hit against blank stops (rigid or pin stops that can rotate) for final positioning prior to forming. The stop heights and locations are chosen to accurately locate the blank and allow the formed product to be removed from the tooling without interference. Typically the inner portions of the blank stops or inner blank stops are lower in height since the formed product must pass over them as described in U.S. Pat. No. 6,592,357.

Instead of web forming, blanks could be rotary cut or reciprocally cut off-line in a separate operation. The blanks could be transferred to the forming tooling via transfer chutes using a blank feed style press. The overall productivity of a blank feed style press can be typically lower than a web feed style press since the stacks of blanks must be continually inserted into the feed section, the presses are commonly narrow in width with fewer forming positions available; and the forming speeds are commonly less since fluid hydraulics are typically used versus mechanical cams and gears.

The following patents contain further information as to materials, processing techniques and equipment and are also incorporated by reference: U.S. Pat. Nos. 8,430,660; 7,337,943; 7,048,176; 6,893,693; 6,733,852; 6,715,630; 6,592,357; 6,589,043; 6,585,506; 6,474,497; 5,249,946; 4,832,676; 4,721,500; and 4,609,140.

The plates described herein can be formed with a heated matched pressware die set utilizing inertial rotating pin blank stops as described in U.S. Pat. No. 6,592,357. For paperboard plate stock of conventional thicknesses in the range of about 0.010" to about 0.040", the springs upon which the lower die half can be mounted are typically constructed such that the full stroke of the upper die results in a force applied between the dies of about 6,000 pounds to about 14,000 pounds or greater. Similar forming pressures and control thereof may likewise be accomplished using hydraulics as will be appreciated by one of skill in the art. The paperboard which can be formed into the blanks can be conventionally produced by a wet laid paper making process and can be typically available in the form of a continuous web on a roll. The paperboard stock can have a basis weight in the range of about 100 pounds to about 400 pounds per 3,000 square foot ream, usually up to about 300 pounds per 3,000 square foot ream, and a thickness or caliper in the range of about 0.010" to about 0.040" as noted above. Lower basis weight paperboard can be used for ease of forming and to save on feedstock costs. Paperboard stock utilized for forming paper plates can be typically formed from bleached pulp fiber and can be usually double clay coated on one side. Such paperboard stock commonly has a moisture (water content) varying from about 4 wt % to about 8 wt % prior to moistening.

The effect of the compressive forces at the rim can be greatest when the proper moisture conditions are maintained within the paperboard. In some examples, the paperboard can have a water or moisture content from a low of about 8 wt %, about 9 wt %, or about 10 wt % to a high of about 10.5 wt %, about 11 wt %, or about 12%. Paperboard having moisture in this range has sufficient moisture to deform and rebond under sufficient temperature and pressure, but not such excessive moisture that water vapor interferes with the forming operation or that the paperboard can be too weak to withstand the forces applied. To achieve the desired moisture levels within the paperboard stock as it comes off the roll, the paperboard can be treated by spraying or rolling on a moistening solution, primarily water, although other components such as lubricants may be added. The moisture content may be monitored with a hand held capacitive type moisture meter to verify that the desired moisture conditions are being maintained or the moisture can be monitored by other suitable means, such as an infra-red system. The plate stock may not be formed for at least six hours after moistening to allow the moisture within the paperboard to equilibrate.

Because of the intended end use of the products, the paperboard stock can be typically impregnated with starch and coated on one side with a liquid proof layer or layers comprising a press-applied, water-based coating applied over the inorganic pigment typically applied to the board during manufacturing. Carboxylated styrene-butadiene resins may be used with or without filler if so desired. In addition, for esthetic reasons, the paperboard stock can be often initially printed before being coated with an overcoat layer. As an example of typical coating material, a first layer of latex coating may be applied over the printed paperboard with a second layer of acrylic coating applied over the first layer. These coatings may be applied either using the conventional printing press used to apply the decorative printing or may be applied using some other form of a conventional press coater. Coatings that can include two pigment (clay) containing layers, with a binder, of about 6 lbs/3,000 $ft^2$ ream or so followed by two acrylic layers of about 0.5-1 lbs/3,000 $ft^2$ ream. The clay containing layers are provided first during board manufacture and the acrylic layers are then applied by press coating methods, e.g., gravure, coil coating, flexographic methods and so forth as opposed to extrusion or film laminating methods which are expensive and may require off-line processing as well as large amounts of coating material. An extruded film, for example, may require 25 lbs/3,000 $ft^2$ ream.

A layer comprising a latex may contain any suitable latex known to the art. By way of example, suitable latexes include styrene-acrylic copolymer, acrylonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetate acrylic copolymer, styrene-butadiene copolymer and acetate ethylene copolymer. The layer containing latex can include, but can be not limited to, one or more of styrene-acrylic copolymer, styrene-butadiene copolymer, or vinyl acetate-acrylic copolymer. In some examples, the layer containing latex can include vinyl acetate ethylene copolymer. A commercially available vinyl acetate ethylene copolymer can be AIRFLEX® 100 HS latex, commercially available from Air Products and Chemicals, Inc. The layer containing latex can include a latex that can be pigmented. Pigmenting the latex increases the coat weight of the layer containing a latex thus reducing runnability problems when using blade cutters to coat the substrate. Pigmenting the latex also improves the resulting quality of print that may be applied to the coated paperboard. Suitable pigments or fillers include kaolin clay, delaminated clays, structured clays, calcined clays, alumina, silica, aluminosilicates, talc, calcium sulfate, ground calcium carbonates, and precipitated calcium carbonates. Other suitable pigments are disclosed, for example, in Kirk-Othmer, Encyclopedia of Chemical Technology, Third Edition, Vol. 17, pp. 798, 799, 815, 831-836. The pigment can include kaolin clay and conventional delaminated coating clay. An available delaminated coating clay can be HYDRAPRINT™ slurry (commercially available from Huber), supplied as a dispersion with a slurry solids content of about 68%. The layer comprising a latex may also contain other additives that are well known in the art to enhance the properties of coated paperboard. By way of example, suitable additives include dispersants, lubricants, defoamers, film-formers, antifoamers, and/or cross-linkers. By way of example, DISPEX N-4™ dispersant (commercially available from Allied Colloids) can be one suitable organic dispersant and contains a 40% solids dispersion of sodium polycarboxylate. By way of example, BERCHEM 4095™ lubricant (commercially available from Bercen) can be one suitable lubricant and contains 100% active coating lubricant based on modified glycerides. By way of example, Foamaster DF-177NS™ defoamer (commercially available from Henkel) can be one suitable defoamer. In some examples, the coating can include multiple layers that each contain a latex.

Typically paperboard for containers can include up to about 6 lbs/3,000 $ft^2$ starch; however, the rigidity can be considerably enhanced by using paperboard of about 9 to about 12 lbs/3,000 $ft^2$ starch, as further discussed in U.S. Pat. Nos. 5,938,112 and 5,326,020, the disclosures of which are incorporated herein by reference.

The stock can be moistened on the uncoated side after all of the printing and coating steps have been completed. In a typical forming operation, the web of paperboard stock can be fed continuously from a roll through a scoring and cutting die to form the blanks which are scored and cut before being fed into position between the upper and lower die halves. The die halves are heated as described above, to aid in the forming process. It has been found that best results are obtained if the upper die half and lower die half—particularly the surfaces thereof—are maintained at a temperature in the range of about 250° F. to about 400° F., or at about 325° F.±25° F. These die temperatures have been found to facilitate rebonding and the plastic deformation of paperboard in the rim areas if the paperboard has the moisture levels. At these die temperatures, the amount of heat applied to the blank can be sufficient to liberate the moisture within the blank and thereby facilitate the deformation of the fibers without overheating the blank and causing blisters from liberation of steam or scorching the blank material. It can be apparent that the amount of heat applied to the paperboard will vary with the amount of time that the dies dwell in a position pressing the paperboard together. The die temperatures are based on the usual dwell times encountered for normal plate production speeds of 40 to 60 pressings a minute, and commensurately higher or lower temperatures in the dies would generally be required for higher or lower production speeds, respectively.

A die set wherein the upper assembly includes a segmented punch member and is also provided with a contoured upper pressure ring can be advantageously employed in carrying out methods for making the plates discussed and described herein. Pleating control can be achieved in some embodiments by lightly clamping the paperboard blank about a substantial portion of its outer portion as the blank can be pulled into the die set and the pleats are formed. For some shapes the sequence may differ somewhat as will be appreciated by one of skill in the art. Paperboard containers configured in accordance with embodiments as discussed and described herein can be formed from scored paperboard blanks.

During the forming process and as a pleat can be formed, internal delamination of the paperboard into a plurality of lamellae occurs, followed by rebonding of the lamellae under heat and pressure into a substantially integrated fibrous structure generally inseparable into its constituent lamellae. The pleat can have a thickness roughly equivalent to the circumferentially adjacent areas of the rim and can be denser than adjacent areas.

The substantially rebonded portion or portions of the pleats in the finished product can extend generally over the entire length (75% or more) of the score which was present in the blank from which the product was made. The rebonded portion of the pleats may extend only over portions of the pleats in an annular region of the periphery of the article in order to impart strength. Such an annular region or regions may extend, for example, around the container extending approximately from the transition of the bottom of the container to the sidewall outwardly to the outer edge of the container, that can be, generally along the entire length of the pleats shown in the Figures above. The rebonded structures may can extend over an annular region which can be less than the entire profile from the bottom of the container to its outer edge. For example, an annular region of rebonded structures oriented in a radial direction may extend around the container from slightly above the first arcuate portion 16 to the outermost edge of evert 46, as discussed hereinafter. Alternatively, an annular region or regions of such rebonded structures may extend over all or only a portion of the length of the frustoconical sidewall 26; over all or part of the inner brim section 27, the second arcuate portion 28, and outer frustoconical brim section 29; over all or part of the arcuate portions 16, 28, 38, 42; and/or any combination thereof. In some examples, the substantially integrated rebonded fibrous structures formed can extend over at least a portion of the length of the pleat, over at least 50% of the length of the pleat or over at least 75% of the length of the pleat. Substantially equivalent rebonding can also occur when pleats are formed from unscored paperboard.

The upper surface of the arched central crown typically provides an arched profile which extends outwardly from the center of the container towards the first arcuate portion over a distance of at least about 80%, 85%, or 90% of the horizontal distance between the center of the container and the first arcuate portion. Typically, the arched profile extends across the center of the container and defines a radius of curvature R0 or in the ratio of R0/D can be generally from about 1.75 to about 14; typically from about 2 to about 12; and in many cases the ratio of R0/D can be from about 2 to about 6. In still other cases, the ratio R0/D can be from about 2 to about 4. Thus, the upwardly convex arched central crown has a crown height of about 0.05" to about 0.4"; typically, the convex arched central crown has a crown height of at least about 0.1", 0.15" or 0.2".

Typical basis weights of the products are from about 80 lbs/3,000 $ft^2$ to about 300 lbs/3,000 $ft^2$, such as from about 155 lbs/3,000 $ft^2$ to about 245 lbs/3,000 $ft^2$. The containers are substantially more rigid than like containers with a generally planar bottom portion and a R2/D ratio of 0.020 or greater. For example, plates 10 or other containers can have a FPI rigidity at least 15% greater, at least 30% greater, or at least 45% greater than a like container with a generally planar bottom portion and a R2/D ratio of 0.020 or greater. In general, the container may exhibit a FPI rigidity of at least 25% greater and up to about 100% greater than a like container with a generally planar bottom portion and a R2/D ratio of 0.020 or greater.

Although embodiments of the present invention have been discussed and described with regard to a disposable plate, it is believed that the same surprising and unexpected results can be obtained with containers in the form of a bowl, tray, platter, or non-round plates.

Examples

The foregoing discussion is further described with reference to the following non-limiting examples. And in the examples that follow, plates having generally the profiles described above were compared, and plates having other profiles were compared by FEA analysis. As shown in the examples below, the disposable paperboard plates according to the present invention possess a significantly increased rigidity while maintaining acceptable outer flange flexural strength. The disposable paperboard plates also possesses a significant 10% to 20% increase in plate rigidity (FPI) using standard paper thickness and weight, and do not substantially change the product height, diameter, stack height or packaging cube.

Computer Modeling for Plate Strength:

Computer finite element modeling (FEA) can be used as a design tool to screen pressware plate, tray and bowl shape, and profiles for strength. The computer model provides relative strength values to quickly screen different plate shapes. This can be extremely useful to determine plate shapes that provide enhanced strength since there are an infinite number of plate shapes resulting from combinations of individual dimensions.

Paperboard can be a relatively complex material to define in terms of mechanical properties. Paperboard can be anisotropic having different tensile, flexural moduli, and other physical properties in its machine, cross machine directions and through the thickness of the paperboard. Pleats that result during material gathering for pressware products are also extremely difficult to computer model. A simplified FEA model can be used, that uses isotropic, homogeneous material properties, and pleatless forming. This can be used as a screening tool to show relative strength differences for various shape/profile options. Physical pressware products, with pleats, can be formed with paperboard/pleats to determine if the shape provides enhanced strength properties. Experience has proven that this FEA modeling technique can be successfully used to develop stronger pressware products.

FEA computer models were conducted with a series of inventive profile variations versus a prior art, nominal 9" diameter plate (DU9). Various profile dimensions related to the lower inside radius (R1), the sidewall angle (A), the upper inside radius (R2), the flange width (W), the upper out radius (R3), and the outer horizontal perimeter (OHP) vertical distance below the uppermost flange height (V) and the overall plate height (H) were computer modeled. All of these profiles had an outer arcuate wrap/included angle (A3) of 50°. The prior art DU9 plate shape has an A3 of 55°. Table 1 summarizes the FEA model dimensions.

TABLE 1

FEA model dimensions for DU9 and D9 OHP Trials 1-7

| Profile ID | R1 | A | R2 | W | R3 | V | H | FEA Rigidity | FEA Rigidity % Diff. |
|---|---|---|---|---|---|---|---|---|---|
| DU9 (prior art) | 0.565 | 27.50 | 0.063 | 0.129 | 0.395 | 0.197 | 0.772 | 422 | (Ref) |
| Trial 1 | 0.568 | 25.00 | 0.054 | 0.293 | 0.180 | 0.163 | 0.739 | 466 | 10% |
| Trial 2 | 0.450 | 25.00 | 0.054 | 0.342 | 0.125 | 0.143 | 0.728 | 475 | 13% |
| Trial 3 | 0.450 | 25.00 | 0.054 | 0.380 | 0.125 | 0.143 | 0.728 | 517 | 23% |
| Trial 4 | 0.568 | 25.00 | 0.054 | 0.380 | 0.125 | 0.143 | 0.720 | 507 | 20% |
| Trial 5 | 0.450 | 24.00 | 0.054 | 0.380 | 0.125 | 0.143 | 0.728 | 521 | 23% |
| Trial 6 | 0.450 | 24.00 | 0.054 | 0.355 | 0.180 | 0.143 | 0.728 | 497 | 18% |
| Trial 7 | 0.568 | 24.00 | 0.054 | 0.380 | 0.125 | 0.143 | 0.720 | 521 | 23% |

Plastic plates were produced using rapid prototype thermoform molds for the prior art DU9 and trial U9 (D9 OHP Trial 5) plate shape. The plates were tested on the FPI rigidity test with results listed below in Table 2A.

TABLE 2A

FPI Rigidity (grams/0.5" deflection) Test Summary

| Plastic Caliper (mils) | DU9 (prior art) | U9 (D9 OHP Trial 5) |
|---|---|---|
| 18 | 348 (Ref.) | 432 (+24%) |
| 20 | 347 (Ref.) | 456 (+31%) |

Rigidity and Rim Stiffness

FPI rigidity is expressed in grams/0.5" deflection and is measured with a Foodservice Packaging Institute Rigidity Tester, available from or through the Foodservice Packaging Institute, Inc., Falls Church, Va., 22043 (www.fpi.org). This test is designed to measure the rigidity (i.e., resistance to buckling and bending) of paper and plastic plates, bowls, dishes, and trays by measuring the force required to deflect the rim of these products a distance of 0.5" while the product is supported at its geometric center. Specifically, the plate specimen is restrained by an adjustable bar on one side and is center supported. The rim or flange side opposite to the restrained side is subjected to 0.5" deflection by means of a motorized cam assembly equipped with a load cell, and the force (grams) is recorded. The test simulates in many respects the performance of a container as it is held in the hand of a consumer, supporting the weight of the container's contents. FPI rigidity is expressed as grams per 0.5" deflection. A higher FPI value is desirable since this indicates a more rigid product. All measurements were done at standard TAPPI conditions for paperboard testing, 72° F. and 50% relative humidity. Geometric mean averages (square root of the MD/CD product) values are reported herein.

Rim Stiffness is a measure of the local rim strength about the periphery of the container as opposed to overall or FPI rigidity. This test has been noted to correlate well with actual consumers' perception of product sturdiness. The FPI rigidity is one measure of the load carrying capability of the plate, whereas Rim Stiffness often relates to what a consumer feels when flexing a plate to gauge its strength. The Rim Stiffness is a computer modeled measurement that predicts the force required to deflect the OHP portion of the rim upwardly 0.1" as the bottom panel of the plate is restrained from moving.

Comparisons of Rigidity and Rim Stiffness of plates described herein with comparative plates of like design appear in Tables 3, 4, and 5, below. In some cases, finite element analysis (FEA) was used instead of actual specimens.

A nominal 10" diameter trial pressed paperboard plates (U10 or D OHP Trial 5) were produced using standard processing techniques. The results are summarized in Table 2B.

TABLE 2B

| Sample | Description | Basis Weight (lb/ 3,000 $ft^2$) | Caliper of one sheet (mils/ sheet) | Plate Rigidity FPI – GM (g) | Plate Rigidity FPI – GM (% diff.) |
|---|---|---|---|---|---|
| 1-1 | DU10 Plates | 213.57 | 18.767 | 453.5 | Ref |
| 2-1 | U10 Plates | 214.08 | 18.523 | 528.6 | 17% |

As is seen by the pressed paper plate rigidity testing for the trial rim U10 plates, they were on average about 17% stronger than the prior art DU10 plates formed with the same material weight and caliper.

The prior art DU10 and the inventive U10 206# paper plates were tested with panelists at Focus Pointe Global in Appleton, Wis. The U10 (D9 OHP Trial 5 profile) plate was not a clear winner. As is seen by the following test results, the trial U rim was directionally lower in terms of preference for "no bending or flexing", "strength" and "overall rating". The main issue appeared to be that the wider flange is more flexible than the prior art DU plate shape and is not preferred by many consumers. The wide plate flange is required to increase the FPI rigidity, but decreases the outer flange flexural strength.

Table 2C lists results for the 10" plate rim study. Test subjects used a nine point rating scale relative to test subjects' personal preferences. The sample size of test subjects was 50.

TABLE 2C

| 10" Plate Rim Study | | | |
|---|---|---|---|
| Attribute | DU10 Plates | U10 Plates | Significance Level 90% |
| Station 1 - Visual | | | |
| Appearance | 4.8 | 4.6 | S |
| Durability To Last Entire Meal | 6.8 | 6.7 | NS |
| Which is preferred | 27 | 23 | NS |
| Station 2 - Handling | | | |
| Strength | 7.3 | 6.9 | NS |
| Ease of Gripping | 7.5 | 7.3 | NS |
| No Bending or Flexing | 6.7 | 6.5 | NS |
| Liking | 6.6 | 5.9 | S |
| Which is preferred | 26 | 24 | NS |
| Station 3- Simulated Usage | | | |
| Room For Food On Plate | 7.9 | 7.8 | NS |
| Strength | 7.9 | 7.6 | NS |
| Moisture/Grease Resistance/ Leak Proof | 7.9 | 8.0 | NS |
| Ease Of Gripping | 7.6 | 7.5 | NS |
| No Bending Or Flexing | 7.7 | 7.3 | NS |
| Protects User From Hot Foods | 7.3 | 7.3 | NS |
| Prevents Food From Spilling/Dropping | 8.1 | 7.9 | NS |
| Strong Enough To Carry One Hand | 7.6 | 7.4 | NS |
| Durable Enough To Last The Entire Meal | 8.0 | 7.9 | NS |
| Overall Rating | 7.7 | 7.5 | NS |

Seventeen more nominal 10" diameter shape options were developed and FEA computer modeled. The goal was to try to increase the FPI rigidity strength while not losing the rim stiffness (force to deflect outer OHP upward 0.1"). This turned out to be a very difficult job to accomplish since they tend to go in opposite directions. A plate that is great for outer rim flexural strength, tends to be lower in FPI rigidity and vice versa. Several shape options with an extended 70 degree wrap with the smaller outer arcuate R3 radius (DU has 55 degree wrap, U has a 50 degree wrap) were developed that still had wide flanges and maintained most of the plate FPI rigidities, and in theory minimized the loss in the outer rim strength. The U10 (D10 OHP Trial 5) profiled plate is about 30% greater FPI rigidity, but 18% lower in the outer rim strength as FEA modeled. Some U2 (new U shape) options were about 25% to about 26% stronger in FPI rigidity and about 6% to about 10% lower in rim stiffness.

Nominal 9" diameter plastic plates were produced using rapid prototype thermoform molds for the prior art DU9 and the U2: U10 62.5 A2 70 Deg. A3 Opt3 plate shape. The force to deflection of the outer rim 0.1" on the OHP section of the plates was tested. The plates were tested on the FPI rigidity test with results listed in Table 3.

TABLE 3

| Sample | Description | Plate Rigidity FPI – GM (g/0.5") | Plate Rigidity FPI – GM (% diff) | Down Rim Flex on OHP (g/0.1") | Down Rim Flex on OHP (% diff) |
|---|---|---|---|---|---|
| 1-1 | DU10 (Prior Art) | 190 | Ref. | 91 | Ref |
| 2-1 | U10 (Trial D10 OHP Trial 5) (Prior Art) | 218 | 14.5% | 75 | −17.6% |
| 3-1 | U10 (Inventive U2: 70 Deg A3 Opt4) | 216 | 13.7% | 81 | −11.0% |

TABLE 3-continued

| Sample | Description | Plate Rigidity FPI – GM (g/0.5") | Plate Rigidity FPI – GM (% diff) | Down Rim Flex on OHP (g/0.1") | Down Rim Flex on OHP (% diff) |
|---|---|---|---|---|---|
| 4-1 | U10 (Inventive U2: 62.5 Deg. A2 70 Deg. A3 Opt3) | 219 | 15.0% | 85 | −6.6% |

All of the proposed U shapes had about a 15% increase in FPI rigidity. The U10 (D10 OHP Trial 5) tested plate had the lowest down rim flex force at 0.1" deflection, which matches the consumer perception of a more flexible outer flange. The 4-1 U10 (Trial U2: 62.5 A2 70 Deg. A3 Opt3) inventive profile plate had the highest down flex when compared to the other trial shapes and was significantly better than the prior, consumer tested 2-1 U10 (D10 OHP Trial 5) shape. The down rim flex force of the 4-1 U10 was closer to parity to the prior art DU10 plate per this test.

Based on hand feel, the U10 (D10 OHP Trial 5) plate had inferior stiffness when flexed at the very outer edge of the plate than the prior art DU10 or two inventive U10 (Trial U2) shapes. Lifting of a bean bag weight in the middle of the prior art U10 plate also showed its inferiority. Table 4 lists the relative dimensions of the plate shapes tested. Table 4 also reports the FEA FPI Rigidity (grams) and FEA computer modeled upward rim flex force (lbs.) on the OHP to get 0.1" deflection.

TABLE 4

| Profile ID | R1 | A | R2 | W | A3 | R3 | V | H | FEA Rigidity | Rigidity (% Diff) | Upward Rim Flex on OHP | Rim Flex (% Diff) |
|---|---|---|---|---|---|---|---|---|---|---|---|---|
| DU10 (Prior Art) | 0.593 | 27.50 | 0.074 | 0.152 | 55.5 | 0.468 | 0.234 | 0.915 | 430 | (Ref) | 0.409 | (Ref) |
| U10 (Trial D10 OHP Trial 5) | 0.532 | 24.00 | 0.063 | 0.450 | 50.0 | 0.148 | 0.170 | 0.861 | 557 | 30% | 0.337 | −18% |
| U10 (Inventive U2: 70° A3 Opt 4) | 0.532 | 24.00 | 0.063 | 0.455 | 70.0 | 0.148 | 0.180 | 0.861 | 541 | 26% | 0.383 | −6% |
| U10 (Inventive U2: 62.5 A2 70° A3 Opt 3) | 0.460 | 27.50 | 0.063 | 0.455 | 70.0 | 0.148 | 0.180 | 0.861 | 539 | 25% | 0.369 | −10% |

As shown in Table 4, the two U2 shapes have significantly higher rigidities and upward rim flex forces that are 6% to 10% lower than the prior art DU10 plate shape. The previous U10 (D10 OHP Trial 5) plate FEA rim flex force was −18% versus the prior art DU10 plates.

The U9 and U10 pressware forming die components were designed and manufactured with the inventive U2 (62.5A2 70 A3 Opt3) profile. Pressed paperboard plates were produced using the standard processing techniques, with control and trial/inventive shaped tooling. The results are summarized in Tables 5 and 6.

TABLE 5

DU versus U2 Nominal 9" Plate Physical Properties

| Sample | Description | Basis Weight (lb/3000 ft$^2$) | Caliper 1 Sheet (mils/1 sheet) | Plate Rigidity FPI – GM (g) | Plate Rigidity FPI – GM (% diff) |
|---|---|---|---|---|---|
| 1-1 | DU9 (Prior Art) | 203 | 17.7 | 362 | Ref |
| 2-1 | DU9 (Prior Art) | 214 | 18.2 | 464 | Ref |
| 3-1 | U9 (Inventive U2: 62.5A2 70 Deg A3 Opt3) | 201 | 17.3 | 420 | 16% |
| 4-1 | U9 (Inventive U2: 62.5A2 70 Deg A3 Opt3) | 214 | 18.1 | 519 | 12% |

TABLE 6

DU versus U2 Nominal 10" Plate Physical Properties

| Description | Forming Die Temp (° F) | Basis Weight (lb/3000 ft$^2$) | Caliper 1 Sheet (mils/1 sheet) | Plate Rigidity FPI – GM (g) | Plate Rigidity FPI – GM (% diff) |
|---|---|---|---|---|---|
| DU10 (Prior Art) | 320 | 215 | 18.4 | 437 | Ref |
| U10 (Inventive U2: 62.5A2 70 Deg A3 Opt3) | 320 | 215 | 18.4 | 477 | 9% |
| DU10 (Prior Art) | 350 | 216 | 18.7 | 459 | Ref |

TABLE 6-continued

DU versus U2 Nominal 10" Plate Physical Properties

| Description | Forming Die Temp (° F) | Basis Weight (lb/3000 ft$^2$) | Caliper 1 Sheet (mils/1 sheet) | Plate Rigidity FPI – GM (g) | Plate Rigidity FPI – GM (% diff) |
|---|---|---|---|---|---|
| U10 (Inventive U2: 62.5A2 70 Deg A3 Opt3) | 350 | 218 | 18.4 | 523 | 14% |

The same sidewall angle can be desired so that the stack height/cube is not increased. Tables 7A and 7B show the stack height comparisons of the U2 plate shape vs. the DU plates. Note that Stack Heights were measured with a weight of 10 pounds contained on a stack of plates.

TABLE 7A

Nominal 9" DU vs. U2 Plate & Stack Height Summary

| 9" | DU Plate Height (in) | U2 Plate Height (in) | U2 vs. DU Plate Height (in) | U2 vs. DU Plate Height (% diff) | DU 100 ct Stack Height (in) | U2 100 ct Stack Height (in) | U2 vs. DU 100 ct Stack Height (in) | U2 vs. DU 100 ct Stack Height (% diff) |
|---|---|---|---|---|---|---|---|---|
| 196# | 0.79 | 0.740 | −0.050 | −6.3% | 4.706 | 4.746 | 0.040 | 0.8% |
| 206# | 0.78 | 0.730 | −0.050 | −6.4% | 4.877 | 4.891 | 0.014 | 0.3% |

TABLE 7B

Nominal 10" DU vs. U2 Plate & Stack Height Summary

| 10" | DU Plate Height (in) | U2 Plate Height (in) | U2 vs. DU Plate Height (in) | U2 vs. DU Plate Height (% diff) | DU 100 ct Stack Height (in) | U2 100 ct Stack Height (in) | U2 vs. DU 100 ct Stack Height (in) | U2 vs. DU 100 ct Stack Height (% diff) |
|---|---|---|---|---|---|---|---|---|
| 206# | 0.92 | 0.869 | −0.051 | −5.5% | 5.084 | 5.166 | 0.082 | 1.6% |

The inventive nominal 10" diameter U10 (U2 62.5A2 70A3 Opt3) plates were panel tested at Focus Pointe Global in Appleton, Wis. There was no statistical difference in consumer perception between the prior art and inventive rim profiles. The U2 rim directionally ranked higher than the prior art DU10 rim by consumer ratings, as indicated in Table 8 with underlined values listed in the U2 Rim column. As can be seen by the test results, the "no bending or flexing", "strength" and "overall rating" was about parity or slightly better than the prior art DU10 plate. The inventive plate profile did not have the outer flange flex issues as the 1st U (D Trial 5 OHP) shape without the extended outer wrap. The inventive U9 and U10 plate shapes can use the U2 62.5A2 70A3 Opt3 profile.

Table 8 lists results for the nominal 10" plate rim study. Test subjects used a nine point rating scale relative to test subjects' personal preferences. The sample size of test subjects was 50. Note, if $p<0.10$, then the means are different at the 90% confidence level.

TABLE 8

Nominal 10" Plate Rim Study

| Attribute | DU10 Rim (prior art) | U2 Rim | p-value | Significance Level 90% |
|---|---|---|---|---|
| Station 1 - Visual | | | | |
| Appearance | 5.22 | 5.26 | 0.727 | NS |
| Durability To Last Entire Meal | 6.60 | 6.66 | 0.652 | NS |
| Preference (Average) | 0.50 | 0.48 | 0.888 | NS |
| Preference (Count) | 25 | 24 | | |
| Station 2 - Handling | | | | |
| Strength | 6.94 | 6.66 | 0.263 | NS |
| Ease of Gripping | 6.90 | 6.98 | 0.739 | NS |
| No Bending or Flexing | 6.14 | 6.24 | 0.731 | NS |
| Liking | 6.58 | 6.50 | 0.777 | NS |
| Preference (Average) | 0.56 | 0.44 | 0.402 | NS |
| Preference (Count) | 28 | 22 | | |

TABLE 8-continued

Nominal 10" Plate Rim Study

| Attribute | DU10 Rim (prior art) | U2 Rim | p-value | Significance Level 90% |
|---|---|---|---|---|
| Station 3 - Simulated Usage | | | | |
| Room For Food On Plate | 7.70 | 7.78 | 0.290 | NS |
| Strength | 7.54 | 7.52 | 0.908 | NS |
| Moisture/Grease Resistance/ Leak Proof | 8.08 | 8.12 | 0.687 | NS |
| Ease Of Gripping | 7.40 | 7.30 | 0.669 | NS |
| No Bending Or Flexing | 7.12 | 7.26 | 0.473 | NS |
| Protects User From Hot Foods | 6.82 | 7.00 | 0.351 | NS |
| Prevents Food From Spilling/Dropping | 7.44 | 7.52 | 0.704 | NS |
| Strong Enough To Carry One Hand | 7.06 | 7.06 | 1 | NS |
| Durable Enough To Last The Entire Meal | 7.84 | 7.78 | 0.652 | NS |
| Overall Rating | 7.50 | 7.52 | 0.909 | NS |
| Preference (Average) | 0.50 | 0.46 | 0.776 | NS |
| Preference (Count) | 25 | 23 | | |

Tables 9A-9C summarize the die profile dimensions for the nominal 10" plates (Table 9A), the FEA rigidity and rim flex for each shape (Table 9B), and the die profile dimension ratios to theoretical plate diameter without paper stretch for the nominal 10" plates (Table 9C).

TABLE 9A

Nominal 10" Plate Die Profile Dimensions (Blank Diameter = 11.094")

| D = X5 * 2 | DU10 (prior art) 9.9800" | U10 - Trial (D10 OHP Trial 5) 9.9974" | U10 - (Inv) (U2: 70° A3 Opt4) 9.9634" | U10 - (Inv) (U2: 62.5 A2 70° A3 Opt3) 9.9902" |
|---|---|---|---|---|
| R0 | 31.0822" | 31.2980" | 31.1350" | 31.2980" |
| X0 | 0.0000" | 0.0000" | 0.0000" | 0.0000" |
| Y0 | −30.8942" | −31.1100" | −30.9432" | −31.1066" |

TABLE 9A-continued

Nominal 10" Plate Die Profile Dimensions (Blank Diameter = 11.094")

| D = X5 * 2 | DU10 (prior art) 9.9800" | U10 - Trial (D10 OHP Trial 5) 9.9974" | U10 - (Inv) (U2: 70° A3 Opt4) 9.9634" | U10 - (Inv) (U2: 62.5 A2 70° A3 Opt3) 9.9902" |
|---|---|---|---|---|
| R1 | 0.5917" | 0.5325" | 0.5325" | 0.4600" |
| X1 | 3.4459" | 3.4544" | 3.4544" | 3.4812" |
| Y1 | 0.5917" | 0.5325" | 0.5325" | 0.4600" |
| R2 | 0.0740" | 0.0633" | 0.0633" | 0.0633" |
| X2 | 4.3252" | 4.2249" | 4.2249" | 4.2472" |
| Y2 | 0.8393" | 0.7981" | 0.7981" | 0.7980" |
| R3 | 0.4674" | 0.1479" | 0.1479" | 0.1479" |
| X3 | 4.4774" | 4.6750" | 4.6794" | 4.7017" |
| Y3 | 0.4459" | 0.7135" | 0.7135" | 0.7134" |
| R4 | 0.0740" | 0.0740" | 0.0740" | 0.0740" |
| X4 | 4.9227" | 4.9208" | 4.9003" | 4.9226" |
| Y4 | 0.7538" | 0.7658" | 0.7554" | 0.7553" |
| X5 | 4.9900" | 4.9987" | 4.9817" | 4.9951" |
| Y5 | 0.6798" | 0.6918" | 0.6814 | 0.6813" |
| A | 27.5° | 24.0° | 24.0° | 27.5° |
| A1 | 62.5° | 65.0° | 65.0° | 62.5° |
| A2 | 62.5° | 65.0° | 65.0° | 62.5° |
| A3 | 55.3° | 50.0° | 70.0° | 70.0° |
| W | 0.1522" | 0.4501" | 0.4545" | 0.4545" |
| V | 0.2335" | 0.1696" | 0.1800" | 0.1800" |
| H | 0.9133" | 0.8614" | 0.8614" | 0.8613" |
| X5 − X4 (OHP) | 0.0673" | 0.0779" | 0.0814" | 0.0725" |

TABLE 9B

FEA Rigidity & Rim Flex.
Shown below for each shape (0.0185" thickness)

| | | | | |
|---|---|---|---|---|
| FEA Rigidity | 430 grams/.5" defl. (Ref.) | 557 (+30%) | 541 (+26%) | 539 (+25%) |
| FEA Rim Flex | 0.409 lbs/.1" defl. (Ref.) | 0.337 (−18%) | 0.383 (−6%) | 0.369 (−10%) |

TABLE 9C

Nominal 10" Plate Die Profile Dimension Ratios to Theoretical Plate Diameter without paper stretch (Blank Diameter = 11.094")

| D = X5 * 2 | DU10 (prior art) 9.9800" | U10 - Trial (D10 OHP Trial 5) 9.9974" | U10 - (Inv) (U2: 70° A3 Opt4) 9.9634" | U10 - (Inv) (U2: 62.5 A2 70° A3 Opt3) 9.9902" |
|---|---|---|---|---|
| R0/D | 3.1145 | 3.1306 | 3.1249 | 3.1329 |
| X0/D | 0.0000 | 0.0000 | 0.0000 | 0.0000 |
| Y0/D | −3.0956 | −3.1118 | −3.1057 | −3.1137 |
| R1/D | 0.0593 | 0.0533 | 0.0534 | 0.0460 |
| X1/D | 0.3453 | 0.3455 | 0.3467 | 0.3485 |
| Y1/D | 0.0593 | 0.0533 | 0.0534 | 0.0460 |
| R2/D | 0.0074 | 0.0063 | 0.0064 | 0.0063 |
| X2/D | 0.4334 | 0.4226 | 0.4240 | 0.4251 |
| Y2/D | 0.0841 | 0.0798 | 0.0801 | 0.0799 |
| R3/D | 0.0468 | 0.0148 | 0.0148 | 0.0148 |
| X3/D | 0.4486 | 0.4676 | 0.4697 | 0.4706 |
| Y3/D | 0.0447 | 0.0714 | 0.0716 | 0.0714 |
| R4/D | 0.0074 | 0.0074 | 0.0074 | 0.0074 |
| X4/D | 0.4933 | 0.4922 | 0.4918 | 0.4927 |
| Y4/D | 0.0755 | 0.0766 | 0.0758 | 0.0756 |
| X5/D | 0.5000 | 0.5000 | 0.5000 | 0.5000 |
| Y5/D | 0.0681 | 0.0692 | 0.0684 | 0.0682 |
| A | 27.5° | 24.0° | 24.0° | 27.5° |
| A1 | 62.5° | 65.0° | 66.0° | 62.5° |
| A2 | 62.5° | 65.0° | 66.0° | 62.5° |
| A3 | 55.3° | 50.0° | 70.0° | 70.0° |
| W/D | 0.0152 | 0.0450 | 0.0456 | 0.0455 |
| V/D | 0.0234 | 0.0170 | 0.0181 | 0.0180 |

TABLE 9C-continued

Nominal 10" Plate Die Profile Dimension Ratios to Theoretical Plate Diameter without paper stretch (Blank Diameter = 11.094")

| D = X5 * 2 | DU10 (prior art) 9.9800" | U10 - Trial (D10 OHP Trial 5) 9.9974" | U10 - (Inv) (U2: 70° A3 Opt4) 9.9634" | U10 - (Inv) (U2: 62.5 A2 70° A3 Opt3) 9.9902" |
|---|---|---|---|---|
| H/D | 0.0915 | 0.0862 | 0.0865 | 0.0862 |
| (X5 − X4)/D (OHP) | 0.0067 | 0.0078 | 0.0082 | 0.0073 |

Tables 10A-10C summarize the die profile dimensions for the nominal 9" plates (Table 10A), the FEA rigidity and rim flex for each shape (Table 10B), and the die profile dimension ratios to theoretical plate diameter without paper stretch for the nominal 9" plates (Table 10C). The 9" versions are scaled down by the blank diameter ratio of 9.375"/11.094" or by 0.845 from the 10" die profiles. The angles for the 9" versions are the same as the 10" versions.

TABLE 10A

Nominal 9" Plate Die Profile Dimensions (Blank Diameter = 9.375")

| D = X5 * 2 | DU9 (prior art) 8.4496" | U9 - Trial (D9 OHP Trial 5) 8.4544" | U9 - (Inv) (U2: 70° A3 Opt4) 8.4198" | U9 - (Inv) (U2: 62.5 A2 70° A3 Opt3) 8.4422" |
|---|---|---|---|---|
| R0 | 25.4837" | 26.2608" | 26.4490" | 26.2608" |
| X0 | 0.0000" | 0.0000" | 0.0000" | 0.0000" |
| Y0 | −25.3248" | −26.1008" | −26.2901" | −26.0979" |
| R1 | 0.5650" | 0.4500" | 0.4500" | 0.3887" |
| X1 | 2.8726" | 2.9192" | 2.9192" | 2.9419" |
| Y1 | 0.5650" | 0.4500" | 0.4500" | 0.3887" |
| R2 | 0.0625" | 0.0535" | 0.0535" | 0.0535" |
| X2 | 3.6551" | 3.5703" | 3.5703" | 3.5891" |
| Y2 | 0.7093" | 0.6745" | 0.6745" | 0.6744" |
| R3 | 0.3950" | 0.1250" | 0.1250" | 0.1250" |
| X3 | 3.7837" | 3.9507" | 3.9544" | 3.9732" |
| Y3 | 0.3768" | 0.6030" | 0.6030" | 0.6029" |
| R4 | 0.0625" | 0.0625" | 0.0625" | 0.0625" |
| X4 | 4.1600" | 4.1584" | 4.1411" | 4.1599" |
| Y4 | 0.6370" | 0.6471" | 0.6384" | 0.6382" |
| X5 | 4.2248" | 4.2272" | 4.2099" | 4.2211" |
| Y5 | 0.5745" | 0.5846" | 0.5759" | 0.5757" |
| A | 27.5° | 24.0° | 24.0° | 27.5° |
| A1 | 62.5° | 66.0° | 66.0° | 62.5° |
| A2 | 62.5° | 66.0° | 66.0° | 62.5° |
| A3 | 55.3° | 50.0° | 70.0° | 70.0° |
| W | 0.1286" | 0.3804" | 0.3841" | 0.3841" |
| V | 0.1973" | 0.1434" | 0.1521" | 0.1521" |
| H | 0.7718" | 0.7280" | 0.7280" | 0.7279" |
| X5 − X4 (OHP) | 0.0648" | 0.0688" | 0.0688" | 0.0612" |

TABLE 10B

FEA Rigidity & Rim Flex.
Shown below for each shape (0.0170" thickness)

| | | | | |
|---|---|---|---|---|
| FEA Rigidity | 422 grams/.5" defl. (Ref.) | 529 (+25%) | 522 (+24%) | 521 (+24%) |
| FEA Rim Flex | 0.424 lbs/.1" defl. (Ref.) | 0.355 (−16%) | 0.385 (−9%) | 0.381 (−10%) |

TABLE 10C

| Nominal 9" Plate Die Profile Dimension Ratios to Theoretical Plate Diameter without paper stretch (Blank Diameter = 9.375") | | | | |
|---|---|---|---|---|
| D = X5 * 2 | DU9 (prior art) 8.4496" | U9 - Trial (D9 OHP Trial 5) 8.4544" | U9 - (Inv) (U2: 70° A3 Opt4) 8.4198" | U9 - (Inv) (U2: 62.5 A2 70° A3 Opt3) 8.4422" |
| R0/D | 3.0160 | 3.1062 | 3.1413 | 3.1189 |
| X0/D | 0.0000 | 0.0000 | 0.0000 | 0.0000 |
| Y0/D | −2.9972 | −3.0872 | −3.1224 | −3.0996 |
| R1/D | 0.0669 | 0.0532 | 0.0534 | 0.0462 |
| X1/D | 0.3400 | 0.3453 | 0.3467 | 0.3494 |
| Y1/D | 0.0669 | 0.0532 | 0.0534 | 0.0462 |
| R2/D | 0.0074 | 0.0063 | 0.0064 | 0.0064 |
| X2/D | 0.4326 | 0.4223 | 0.4240 | 0.4263 |
| Y2/D | 0.0839 | 0.0798 | 0.0801 | 0.0801 |
| R3/D | 0.0467 | 0.0148 | 0.0148 | 0.0148 |
| X3/D | 0.4478 | 0.4673 | 0.4697 | 0.4719 |
| Y3/D | 0.0446 | 0.0713 | 0.0716 | 0.0716 |
| R4/D | 0.0074 | 0.0074 | 0.0074 | 0.0074 |
| X4/D | 0.4923 | 0.4919 | 0.4918 | 0.4941 |
| Y4/D | 0.0754 | 0.0765 | 0.0758 | 0.0758 |
| X5/D | 0.5000 | 0.5000 | 0.5000 | 0.5000 |
| Y5/D | 0.0680 | 0.0691 | 0.0684 | 0.0684 |
| A | 27.5° | 24.0° | 24.0° | 27.5° |
| A1 | 62.5° | 65.0° | 66.0° | 62.5° |
| A2 | 62.5° | 65.0° | 66.0° | 62.5° |
| A3 | 55.3° | 50.0° | 70.0° | 70.0° |
| W/D | 0.0152 | 0.0450 | 0.0456 | 0.0456 |
| V/D | 0.0234 | 0.0170 | 0.0181 | 0.0181 |
| H/D | 0.0913 | 0.0861 | 0.0865 | 0.0865 |
| (X5 − X4)/D (OHP) | 0.0077 | 0.0081 | 0.0082 | 0.0073 |

Tables 11A-11C summarize the die profile dimensions for the Hart Pie Plate profile (J. M. Hart, 1932, U.S. Pat. No. 1,866,035) when scaled up to a 8.45" diameter plate to be similar in diameter to the prior art plates and the inventive nominal 9" plates (Table 11A), the FEA rigidity and rim flex for each shape (Table 11B), and the die profile dimension ratios to theoretical plate diameter without paper stretch for the Hart Pie Plate profile (Table 11C).

TABLE 11A

| The Hart Pie Plate - Die Profile Dimensions (Blank Diameter = 9.76"/+8.3% more area) | | |
|---|---|---|
| D = X5 * 2 | Hart Pie Plate Profile - 8.45" Diam. Plate (Blank Diameter = 9.76"/ +8.3% more area) 8.450" | Hart Pie Plate Profile with U9 R2, R3, R4 Radii - 8.45" Diam. Plate (Blank Diameter = 9.73"/ +7.7% more area) 8.450" |
| R0 | 0.000" | 0.000" |
| X0 | 0.000" | 0.000" |
| Y0 | 0.000" | 0.000" |
| R1 | 0.481" | 0.481" |
| X1 | 2.581" | 2.463" |
| Y1 | 0.481" | 0.481" |
| R2 | 0.000" | 0.0535" |
| X2 | 3.767" | 3.675" |
| Y2 | 1.218" | 1.165" |
| R3 | 0.000" | 0.125" |
| X3 | 3.921" | 3.829" |
| Y3 | 1.218" | 1.093" |
| R4 | 0.000" | 0.0625" |
| X4 | 4.071" | 4.071" |
| Y4 | 1.026" | 1.088" |
| X5 | 4.225" | 4.225" |
| Y5 | 1.026" | 1.026" |
| A | 38° | 38° |
| A1 | 52° | 52° |
| A2 | 52° | 52° |

TABLE 11A-continued

| The Hart Pie Plate - Die Profile Dimensions (Blank Diameter = 9.76"/+8.3% more area) | | |
|---|---|---|
| D = X5 * 2 | Hart Pie Plate Profile - 8.45" Diam. Plate (Blank Diameter = 9.76"/ +8.3% more area) 8.450" | Hart Pie Plate Profile with U9 R2, R3, R4 Radii - 8.45" Diam. Plate (Blank Diameter = 9.73"/ +7.7% more area) 8.450" |
| A3 | 52° | 52° |
| W | 0.154" | 0.154" |
| V | 0.192" | 0.192" |
| H | 1.218" | 1.218" |
| X5 − X4 (OHP) | 0.154" | 0.154" |

TABLE 11B

| FEA Rigidity & Rim Flex. Shown below for each shape (0.0170" thickness) | | |
|---|---|---|
| FEA Rigidity | 290 grams/.5" defl. (−31%) | 380 grams/.5" defl. (−10%) |
| FEA Rim Flex | 0.936 lbs/.1" defl. (+120%) | 0.716 lbs/.1" defl. (+69%) |

TABLE 11C

| The Hart Pie Plate - Die Profile Dimension Ratios to Theoretical Plate Diameter without paper stretch (Blank Diameter = 9.76"/+8.3% more area) | | |
|---|---|---|
| D = X5 * 2 | Hart Pie Plate Profile - 8.45" Diam. Plate (Blank Diameter = 9.76"/ +8.3% more area) 8.450" | Hart Pie Plate Profile with U9 R2, R3, R4 Radii - 8.45" Diam. Plate (Blank Diameter = 9.73"/ +7.7% more area) 8.450" |
| R0/D | 0.000 | 0.000 |
| X0/D | 0.000 | 0.000 |
| Y0 | 0.000 | 0.000 |
| R1/D | 0.057 | 0.057 |
| X1/D | 0.305 | 0.291 |
| Y1/D | 0.057 | 0.057 |
| R2/D | 0.000 | 0.0064 |
| X2/D | 0.446 | 0.435 |
| Y2/D | 0.144 | 0.138 |
| R3/D | 0.000 | 0.0148 |
| X3/D | 0.464 | 0.453 |
| Y3/D | 0.144 | 0.129 |
| R4/D | 0.000 | 0.0074 |
| X4/D | 0.482 | 0.482 |
| Y4/D | 0.121 | 0.129 |
| X5/D | 0.500 | 0.500 |
| Y5/D | 0.121 | 0.121 |
| A | 38° | 38° |
| A1 | 52° | 52° |
| A2 | 52° | 52° |
| A3 | 52° | 52° |
| W/D | 0.018 | 0.018 |
| V/D | 0.023 | 0.023 |
| H/D | 0.144 | 0.144 |
| X5 − X4/D (OHP) | 0.018 | 0.018 |

Tables 12A and 12B summarize the die profile dimensions for the 9" inventive plate profiles described herein, and the prior art DU9, U9 Trial (D9 OHP Trial), and the Hart Pie Plate profiles. Note that in Tables 12A and 12B, the die profile dimensions for the Hart Pie Plate profile were scaled up to a 8.45" diameter plate to be similar in diameter to the prior art plates and the inventive nominal 9" plates. The inventive plate profiles with the wider W=0.3841 inches, and A3=70° are substantially greater than the prior art DU9 plate shape (+23% to +24% per FEA model).

It can be noted though that the upward rim flex force on the OHP is substantially lower for the U9 trial (D9 OHP Trial 5) plates where the A3 angular wrap can be 50° (−16%). The two inventive plate profiles are about 9% to about 10% lower in rim flex force the prior art DU9 plate profile, which can be substantially less than the U9 trial plate (−9% to −10%).

TABLE 12A

Nominal 9" Plate Computer FEA Modeling Summary

| Profile ID | R1 | A | R2 | A3 | W | R3 | H | V | D | Blank Diam (in) | FEA Rigidity | Rigidity (% Diff) | Upward Rim Flex on OHP | Rim Flex (% Diff) |
|---|---|---|---|---|---|---|---|---|---|---|---|---|---|---|
| DU9 (Prior Art) | 0.5650 | 27.5 | 0.6250 | 55.3 | 0.1286 | 0.3950 | 0.7718 | 0.1973 | 8.450 | 9.375 (Ref) | 422 | (Ref) | 0.424 | (Ref) |
| U9 (D9 OHP Trial 5) | 0.4500 | 24.0 | 0.5350 | 50.0 | 0.3804 | 0.1250 | 0.7280 | 0.1434 | 8.454 | 9.375 | 529 | 25% | 0.355 | −16% |
| Hart Pie Plate | 0.4810 | 38.0 | 0.0000 | 52.0 | 0.1540 | 0.0000 | 1.2180 | 0.1920 | 8.450 | 9.76 (+4.1%) | 290 | −31% | 0.936 | 121% |
| U9 (Inv U2: 70° A3 Opt 4) | 0.4500 | 24.0 | 0.5350 | 70.0 | 0.3841 | 0.1250 | 0.7280 | 0.1521 | 8.420 | 9.375 | 522 | 24% | 0.385 | −9% |
| U9 (Inv U2: 62.5 A2 70° A3 Opt 3) | 0.4500 | 27.5 | 0.5350 | 70.0 | 0.3841 | 0.1250 | 0.7279 | 0.1521 | 8.442 | 9.375 | 521 | 23% | 0.381 | −10% |

30

TABLE 12B

Nominal 9" Plate Computer FEA Modeling Summary

| Profile ID | R1/D | A | R2/D | A3 | W/D | R3/D | H/D | V/D | D | Blank Diam (in) | FEA Rigidity | Rigidity (% Diff) | Upward Rim Flex on OHP | Rim Flex (% Diff) |
|---|---|---|---|---|---|---|---|---|---|---|---|---|---|---|
| DU9 (Prior Art) | 0.0669 | 27.5 | 0.0074 | 55.3 | 0.0152 | 0.0467 | 0.0913 | 0.0234 | 0.0669 | 9.375 (Ref) | 422 | (Ref) | 0.424 | (Ref) |
| U9 (D9 OHP Trial 5) | 0.0532 | 24.0 | 0.0063 | 50.0 | 0.0450 | 0.0148 | 0.0861 | 0.0170 | 0.0532 | 9.375 | 529 | 25% | 0.355 | −16% |
| Hart Pie Plate | 0.0569 | 38.0 | 0.0000 | 52.0 | 0.0182 | 0.0000 | 0.1441 | 0.0227 | 0.0569 | 9.76 (+4.1%) | 290 | −31% | 0.936 | 121% |
| U9 (Inv U2: 70° A3 Opt 4) | 0.0534 | 24.0 | 0.0064 | 70.0 | 0.0456 | 0.0148 | 0.0865 | 0.0181 | 0.0534 | 9.375 | 522 | 24% | 0.385 | −9% |
| U9 (Inv U2: 62.5 A2 70° A3 Opt 3) | 0.0462 | 27.5 | 0.0064 | 70.0 | 0.0456 | 0.0148 | 0.0865 | 0.0181 | 0.0462 | 9.375 | 521 | 23% | 0.381 | −10% |

Tables 13A and 13B summarize the die profile dimensions for the nominal 10" inventive plate profiles with +5 degree and −5 degree ranges for A3 around the U10 Inventive U2: 62.5A2 70DegA3 Opt3 profile (Inventive 1, 2, and 3 profiles) vs. the prior art DU10 plate and two other trial plate profiles with A3=55° and A=60°. Note that in Tables 13A and 13B, an 11.094" blank diameter was used for all profiles.

TABLE 13A

Nominal 10" Plate Computer FEA Modeling + and − A3 Ranges (Degrees)

| Profile ID | A3 | W | R3 | H | V | D | FEA Rigidity | Rigidity (% Diff) | Upward Rim Flex on OHP | Rim Flex (% Diff) |
|---|---|---|---|---|---|---|---|---|---|---|
| DU10 - prior art | 55.3 | 0.1522 | 0.4674 | 0.9133 | 0.2335 | 9.980 | 430 | (Ref) | 0.409 | (Ref) |
| Trial 1 | 55.0 | 0.4545 | 0.1479 | 0.8614 | 0.1800 | 10.011 | 547 | 27% | 0.342 | −16% |
| Trial 2 | 60.0 | 0.4545 | 0.1479 | 0.8614 | 0.1800 | 10.003 | 542 | 26% | 0.350 | −14% |
| Inv. 1 | 70.0 (+0°) | 0.4545 | 0.1479 | 0.8614 | 0.1800 | 9.990 | 539 | 25% | 0.369 | −10% |
| Inv. 2 | 65.0 (−5°) | 0.4545 | 0.1479 | 0.8614 | 0.1800 | 9.996 | 540 | 26% | 0.366 | −11% |
| Inv. 3 | 75.0 (+5°) | 0.4545 | 0.1479 | 0.8614 | 0.1800 | 9.987 | 537 | 25% | 0.368 | −10% |

25

TABLE 13B

Nominal 10" Plate Computer FEA Modeling + and − A3 Ranges (Degrees)

| Profile ID | A3 | W/D | R3/D | H/D | V/D | D | FEA Rigidity | Rigidity (% Diff) | Upward Rim Flex on OHP | Rim Flex (% Diff) |
|---|---|---|---|---|---|---|---|---|---|---|
| DU10 - prior art | 55.3 | 0.0152 | 0.0468 | 0.0915 | 0.0234 | 9.980 | 430 | (Ref) | 0.409 | (Ref) |
| Trial 1 | 55.0 | 0.0454 | 0.0148 | 0.0860 | 0.0180 | 10.011 | 547 | 27% | 0.342 | −16% |
| Trial 2 | 55.0 | 0.0454 | 0.0148 | 0.0861 | 0.0180 | 10.003 | 542 | 26% | 0.337 | −18% |
| Inv. 1 | 70.0 (+0°) | 0.0455 | 0.0148 | 0.0862 | 0.0180 | 9.990 | 539 | 25% | 0.369 | −10% |
| Inv. 2 | 65.0 (−5°) | 0.0455 | 0.0148 | 0.0862 | 0.0180 | 9.996 | 540 | 26% | 0.366 | −11% |
| Inv. 3 | 75.0 (+5°) | 0.0455 | 0.0148 | 0.0863 | 0.0180 | 9.987 | 537 | 25% | 0.368 | −10% |

The plate rigidities for the greater W width trial and inventive plates are all substantially greater than the prior art DU10 plate shape (+25% to +27% per FEA model). It can be noted though that the upward rim flex force on the OHP is substantially lower for the trial 1 and trial 2 plates where the A3 angular wrap can be 55° and 60° (−16% to 18%) which can be very comparable to the U10 trial (D10 OHP Trial 5) plate shape produced and consumer tested with a A3=50° and a upward rim flex of 0.337 (−18%).

The three inventive plate profiles with the wider W=0.4545 inches and A3 ranging from 65° to 75° are about 10%-11% lower in rim flex force the prior art DU10 plate profile, but as seen above deemed to be acceptable per consumer testing with food.

Tables 14A and 14B summarize the die profile dimensions for the 10" inventive plate profiles with +0.050 inches and −0.050 inch ranges for W around the U10 Inventive U2: 62.5A2 70DegA3 Opt3 profile vs. the prior art DU10 plate and one other trial plate profiles with W=0.3545 inches (−0.100").

TABLE 14A

Nominal 10" Plate Computer FEA Modeling + and − W Ranges (in)

| Profile ID | W | A3 | R3 | H | V | D | FEA Rigidity | Rigidity (% Diff) | Upward Rim Flex on OHP | Rim Flex (% Diff) |
|---|---|---|---|---|---|---|---|---|---|---|
| DU10 - prior art | 0.1522 | 55.3 | 0.4674 | 0.9133 | 0.2335 | 9.980 | 430 | (Ref) | 0.409 | (Ref) |
| Trial 1 | 0.3545 | 70.0 | 0.1479 | 0.8614 | 0.1800 | 9.990 | 437 | 2% | 0.454 | 11% |
| Inv. 1 | 0.4545 (+0.000) | 70.0 | 0.1479 | 0.8614 | 0.1800 | 9.990 | 539 | 25% | 0.369 | −10% |
| Inv. 2 | 0.4045 (−0.050) | 70.0 | 0.1479 | 0.8614 | 0.1800 | 9.990 | 486 | 13% | 0.407 | 0% |

TABLE 14A-continued

| Nominal 10" Plate Computer FEA Modeling + and − W Ranges (in) | | | | | | | | | | |
|---|---|---|---|---|---|---|---|---|---|---|
| Profile ID | W | A3 | R3 | H | V | D | FEA Rigidity | Rigidity (% Diff) | Upward Rim Flex on OHP | Rim Flex (% Diff) |
| Inv. 3 | 0.5045 (+0.050) | 70.0 | 0.1479 | 0.8614 | 0.1800 | 9.990 | 589 | 37% | 0.329 | −20% |

TABLE 14B

| Nominal 10" Plate Computer FEA Modeling + and − W Ranges (in) | | | | | | | | | | |
|---|---|---|---|---|---|---|---|---|---|---|
| Profile ID | W/D | A3 | R3/D | H/D | V/D | D | FEA Rigidity | Rigidity (% Diff) | Upward Rim Flex on OHP | Rim Flex (% Diff) |
| DU10 - prior art | 0.0152 | 55.3 | 0.0468 | 0.0915 | 0.0234 | 9.980 | 430 | (Ref) | 0.409 | (Ref) |
| Trial 1 | 0.3545 | 70.0 | 0.0148 | 0.0862 | 0.0180 | 9.990 | 437 | 2% | 0.454 | 11% |
| Inv. 1 | 0.0455 (+0.000) | 70.0 | 0.0148 | 0.0862 | 0.0180 | 9.990 | 539 | 25% | 0.369 | −10% |
| Inv. 2 | 0.0405 (−0.005) | 70.0 | 0.0148 | 0.0862 | 0.0180 | 9.990 | 486 | 13% | 0.407 | 0% |
| Inv. 3 | 0.0505 (+0.005) | 70.0 | 0.0148 | 0.0862 | 0.0180 | 9.990 | 589 | 37% | 0.329 | −20% |

The plate rigidities for the greater W width inventive plates are all substantially greater than the prior art DU10 plate shape (+13% to +37% per FEA model). The plate rigidity increases with the flange width W. The rim flex can be the opposite, decreasing as the flange width increases. The plate 1 has a +25% higher rigidity with a −10% decrease in rim flex. Inventive plate 2 with a flange width of 0.4045" (−0.050" has comparable rim flex to the prior art DU10 plate, but only increases rigidity 13% per the FEA model. The inventive plate 3 increases plate rigidity by 37%, but has up to a 20% loss in rim flex due to its 0.5045" wider W flange (+0.050"). This may still be consumer acceptable due to the plate's high rigidity.

The profiles of the U9 and U10 plates described above had an arched crowned bottom with a convex upper surface. Other U9 and U10 plates were pressed from paperboard had a substantially flat bottom panel (e.g., lacked the crowned bottom). Rigidity of U9 and U10 plates with and without crowned bottoms were tested and the results are summarized in Tables 15A and 15B. The plate rigidities for inventive U9 and U10 plates were determined at +22% to +24% per FEA models.

TABLE 15A

| Nominal 9" Plate FEA Rigidity Test Summary (0.0175" paperboard) | | | | |
|---|---|---|---|---|
| | With Crowned Bottom | | Without Crowned Bottom | |
| Description | FEA Plate Rigidity (g/0.5") | FEA Plate Rigidity (% diff) | FEA Plate Rigidity (g/0.5") | FEA Plate Rigidity (% diff) |
| DU9 (Prior Art) | 422 | Ref. | 273 | Ref. |
| U9 (Trial D10 OHP Trial 5) | 529 | 25% | 343 | 26% |

TABLE 15A-continued

| Nominal 9" Plate FEA Rigidity Test Summary (0.0175" paperboard) | | | | |
|---|---|---|---|---|
| | With Crowned Bottom | | Without Crowned Bottom | |
| Description | FEA Plate Rigidity (g/0.5") | FEA Plate Rigidity (% diff) | FEA Plate Rigidity (g/0.5") | FEA Plate Rigidity (% diff) |
| U9 (Inventive U2: 70° A3 Opt4) | 522 | 24% | 338 | 24% |
| U9 (Inventive U2: 62.5°; A2 70° A3 Opt3) | 521 | 24% | 333 | 22% |

TABLE 15B

| Nominal 10" Plate FEA Rigidity Test Summary (0.0185" paperboard) | | | | |
|---|---|---|---|---|
| | With Crowned Bottom | | Without Crowned Bottom | |
| Description | FEA Plate Rigidity (g/0.5") | FEA Plate Rigidity (% diff) | FEA Plate Rigidity (g/0.5") | FEA Plate Rigidity (% diff) |
| DU10 (Prior Art) | 430 | Ref. | 259 | Ref. |
| U10 (Trial D10 OHP Trial 5) | 557 | 30% | 322 | 24% |
| U10 (Inventive U2: 70° A3 Opt4) | 541 | 26% | 319 | 23% |
| U10 (Inventive U2: 62.5°; A2 70° A3 Opt3) | 539 | 25% | 315 | 22% |

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. And if applicable, all patents, test procedures, and other documents cited in this application are fully incorporated by reference to the extent such disclosure is not inconsistent with this application and for all jurisdictions in which such incorporation is permitted.

While the foregoing is directed to certain illustrative embodiments, other and further embodiments of the invention is devised without departing from the basic scope thereof, and the scope thereof is determined by the claims that follow.

What is claimed is:

1. A disposable paperboard plate, comprising:

a bottom panel;

a frustoconical sidewall extending upward and outward from the bottom panel;

a first arcuate portion located between the bottom panel and a first end of the frustoconical sidewall, the first arcuate portion having a radius of curvature (R1);

an inner brim section adjacent the frustoconical sidewall, the inner brim section having a width (W);

a second arcuate portion located between a second end of the frustoconical sidewall and a first end of the inner brim section, the second arcuate portion having a radius of curvature (R2);

an outer frustoconical brim section extending downward and out from the inner brim section;

an outer perimeter section extending outward from the outer frustoconical brim section, the plate having an overall diameter (D);

a third arcuate portion located between the inner brim section and the outer frustoconical brim section, wherein the third arcuate portion has a radius of curvature (R3) that is less than 0.20 inches; and a fourth arcuate portion located between the outer frustoconical brim section and the outer perimeter section, the fourth arcuate portion having a radius of curvature (R4), wherein a ratio of W/D is 0.04 to 0.05, a ratio of R3/D is 0.01 to 0.02, and the outer frustoconical brim section extends downward and outward at an angle (A3) of 65° to 75° with respect to a vertical that is substantially perpendicular to the bottom panel.

2. The disposable paperboard plate of claim 1, wherein the frustoconical sidewall has an angle of inclination with respect to the bottom panel of about 10° to about 50°.

3. The disposable paperboard plate of claim 2, wherein the angle of inclination of the frustoconical sidewall is about 20° to about 30°.

4. The disposable paperboard plate of claim 1, wherein a ratio of the length of the frustoconical sidewall to the overall diameter of the plate is greater than 0.025.

5. The disposable paperboard plate of claim 1, wherein the overall diameter is about 6 inches to about 12 inches.

6. A disposable paperboard plate, comprising:

a bottom panel having an arched central crown with a convex upper surface;

a frustoconical sidewall extending upward and outward from the bottom panel;

a first arcuate portion located between the bottom panel and a first end of the frustoconical sidewall, the first arcuate portion having a radius of curvature (R1);

an inner brim section adjacent the frustoconical sidewall, the inner brim section having a width (W);

a second arcuate portion located between a second end of the frustoconical sidewall and a first end of the inner brim section, the second arcuate portion having a radius of curvature (R2);

an outer frustoconical brim section extending downward and out from the inner brim section;

an outer perimeter section extending outward from the outer frustoconical brim section, the plate having an overall diameter (D);

a third arcuate portion located between the inner brim section and the outer frustoconical brim section, wherein the third arcuate portion has a radius of curvature (R3) that is less than 0.20 inches; and a fourth arcuate portion located between the outer frustoconical brim section and the outer perimeter section, the fourth arcuate portion having a radius of curvature (R4), wherein a ratio of W/D is 0.041 to 0.050, a ratio of R3/D is 0.010 to 0.017, and the outer frustoconical brim section extends downward and outward at an angle (A3) of 65° to 75° with respect to a vertical that is substantially perpendicular to the bottom panel.

7. The disposable paperboard plate of claim 6, wherein the frustoconical sidewall has an angle of inclination with respect to the bottom panel of about 10° to about 50°.

8. The disposable paperboard plate of claim 7, wherein the angle of inclination of the frustoconical sidewall is about 20° to about 30°.

9. The disposable paperboard plate of claim 6, wherein a ratio of the length of the frustoconical sidewall to the overall diameter of the plate is greater than 0.025.

10. The disposable paperboard plate of claim 6, wherein the overall diameter is about 6 inches to about 12 inches.

* * * * *